United States Patent [19]

Duester

[11] 4,450,639

[45] May 29, 1984

[54] HANGER WITH SIZE INDICATOR PANEL

[75] Inventor: Everett L. Duester, Zeeland, Mich.

[73] Assignee: John Thomas Batts, Inc., Zeeland, Mich.

[21] Appl. No.: 364,770

[22] Filed: Apr. 2, 1982

[51] Int. Cl.[3] ..... A47J 51/098; G09F 3/10; G09F 3/16

[52] U.S. Cl. ..... 40/322; 223/85; 223/92

[58] Field of Search ..... 40/322; 206/281; 223/85, 87, 92, 93, 88; D6/247, 254, 255, 257

[56] References Cited

U.S. PATENT DOCUMENTS

| | | | |
|---|---|---|---|
| D. 264,912 | 6/1982 | Bliss et al. | D6/254 |
| 3,949,914 | 4/1976 | Ostroll | 40/322 X |
| 4,101,059 | 7/1978 | Batts et al. | 40/322 X |
| 4,115,940 | 9/1978 | Phillips | 40/322 |
| 4,123,864 | 11/1978 | Batts et al. | 40/322 |
| 4,137,661 | 2/1979 | Johansson | 40/322 |

*Primary Examiner*—Robert Mackey

*Attorney, Agent, or Firm*—Price, Heneveld, Huizenga, & Cooper

[57] ABSTRACT

The garment hanger is of the one-piece molded plastic type and has a supporting hook with a straight intermediate portion between its base and support engaging end. The intermediate portion has a laterally extending vertical panel for mounting an indicia displaying tally. The panel is inclined at an angle to the plane of the lateral or lengthwise axis of the hanger whereby the indicia on the tally is simultaneously visible from both the front and one end of the hanger.

7 Claims, 9 Drawing Figures

HANGER WITH SIZE INDICATOR PANEL

FIELD OF THE INVENTION

This invention relates to garment hangers and more particularly to a means for displaying a tally on a one-piece unitary, molded plastic garment hanger. The invention provides a means in the hook portion of the garment hanger to which a label or similar device can be attached to indicate information such as size concerning the garment. The device is of the type which permits the indicia bearing tally to be replaced as needed so that the hanger is capable of reuse with a garment of a different type or size.

DESCRIPTION OF THE PRIOR ART

Heretofore, various types of replaceable indicia bearing members have been developed for garment hangers. U.S. Pat. No. 4,123,864 issued Nov. 7, 1978 to John H. Batts et al. entitled "TALLY FOR ARTICLE DISPLAYS" discloses a replaceable tally mountable on a boss molded about the base of a wire supporting hook for a garment hanger. U.S. Pat. No. 4,101,059 issued July 18, 1978 to John H. Batts et al. entitled "TALLY" discloses a hanger having a pocket at the base of the molded hook or at the end of one arm of the hanger for receiving a slide-in, indicia bearing panel or tally member. In each case, the tally is located close to the main body of the garment. Particularly is this true in the case of the conventional hanger designed for coats, jackets, blouses or sweaters. These types of garments normally have a collar which frequently conceals the tally, thus rendering it basically ineffective. When the tally is concealed, one of its primary purposes is negated because the tallys are used for the purpose of making quick and easy identification of the characteristics of the garment without the necessity of manipulating the garment or removing it from the hanger or the hanger from the rack. Another problem has been that in some constructions the tally can be read only in one direction, that is, it can be read only from the front or from the end of the hanger. This can be a problem because garments are displayed in various ways such that when the hanger is used with one type of garment the tally should be readable from the front and when used with the different type of garment it should be readable from the end of the hanger.

One-piece molded plastic garment hangers of the type used in the women's clothing field are normally designed for use with lightweight garments and, therefore, are of minimum structure and cost. The means for applying a tally to this type of garment necessitates both simplicity and avoidance of a construction which might impair the strength of the hanger. These limitations have frustrated prior efforts to provide a satisfactory means of mounting a detachable tally of such hangers.

BRIEF DESCRIPTION OF THE INVENTION

This invention provides a lightweight, minimum structure hanger with a tally construction so located that the tally is always visible irrespective of the construction of the garment. It is located on the hook well above the body of the hanger, the spacing being such as to eliminate concealment of the tally by any portion of the garment such as a collar. Also, the invention locates the tally at an angle to the lateral axis of the hanger whereby it can be read either from the front or from one end and, thus, is usable under either circumstances. The tally support does not weaken the hanger's structure even though it does not require reinforcement or the use of any additional plastic. Further, the construction of the tally support is such that the hanger can be molded in a simple two-part mold which separates along a parting line extending the length of the hanger and requiring no movable cams. Further, the tally supporting panel can be used with tally members of various types.

DESCRIPTION OF THE PREFERRED EMBODIMENT

Figure 1:
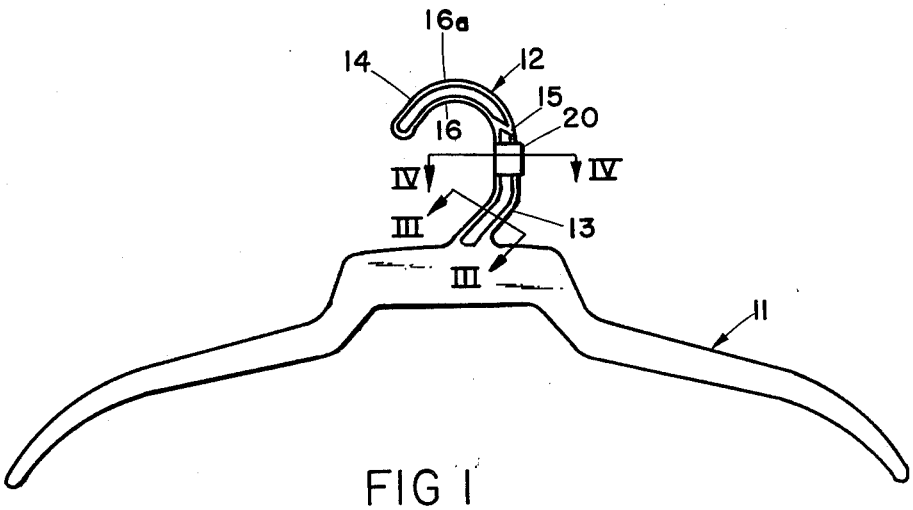
FIG. 1 is a front elevation view of a molded plastic garment hanger equipped with this invention.

The numeral 10 indicates a hanger having a main body portion 11 and a hook portion 12. The hook and body portions are molded as a single integral unit from a suitable plastic material such as polyethylene, polystyrene or polycarbonate. Such molded, plastic unitary hangers are well known in the field.

The hook 12 has a base portion 13 and a convexly curved anchor portion 14 connected by an intermediate portion 15. The base portion is of such length that the intermediate portion is spaced well above the top of the main body portion 11. Thus, the intermediate portion will project above the collars of garments with which the hanger will be used. The intermediate portion is straight and constitutes a vertical section spacing a hook-like convex portion further from the body portion than is normal in molded plastic hangers of this type.

Except in the intermediate portion, the hook is of the conventional I-beam type of cross-sectional construction having front-to-back extending flanges 16 and **16*a* interconnected by a web 16*b***. This type of construction provides a maximum of rigidity and strength for a minimum amount of material and also permits the hanger to have a minimum front-to-back thickness while providing adequate strength to support the type of garments for which it is designed. This I-beam structure is conventional in garment hangers of this general type.

Figure 2:
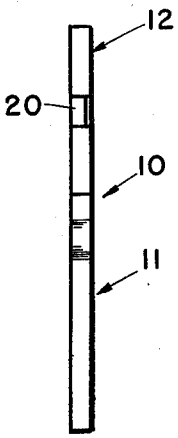
FIG. 2 is an end view taken from the right hand end of FIG. 1.
Figure 3:
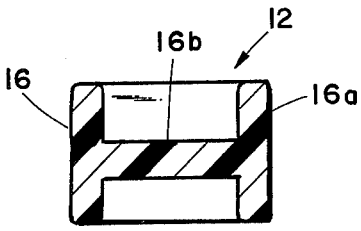
FIG. 3 is a sectional view taken along the plane III—III of FIG. 1.
Figure 4:
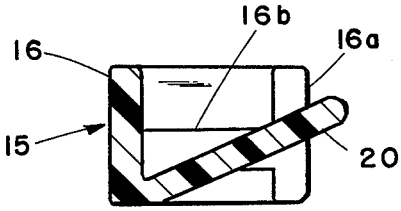
FIG. 4 is a sectional view taken along the plane IV—IV of FIG. 1.

In the intermediate area, the flange **16*a* facing away from the pocket formed by the convex anchor portions is interrupted by a panel 20. The panel 20 along one edge is integral and flush with the front face of the flange 16 and then extends rearwardly at a minor angle to the plane of the lateral axis of the hanger through what would have been the opposite flange 16*a* and projects beyond that flange a short distance as will be seen in FIGS. 1 and 5. The thickness of the panel 20 is approximately the same as that of the flanges 16 and 16***a* and preferably has parallel front and rear faces. The angle at which it is inclined to the plane of the front face of the hanger is dependent upon the thickness of the hanger. The greater the thickness of the hanger, the greater can be the angle of inclination. For example, in a hanger having a front-to-back overall thickness of approximately 3/16 of an inch, the inclination of the panel can be about 27° and in the case of a hanger of approximately ¼ inch thickness, the angle of inclination can be approximately 30°. The front face of the panel is flat and in the preferred embodiment the back face is similar in construction. It will be observed from FIG. 2 that the front face of the panel is clearly visible when the hanger is observed from a position normal to the plane of the front face of the hanger. In a similar manner, when observed from the end of the hanger opposite from the direction of the support hook or a minor angle forwardly of the end, indicia appearing on the front face of the panel can also be observed. Thus the panel's construction and position makes it readily visible from either the front or the one end. It is preferable that the width of the panel be such that its free edge does not project beyond the rear face of the hanger to interfere with stacking of the hangers during bulk shipment.

Figure 8:
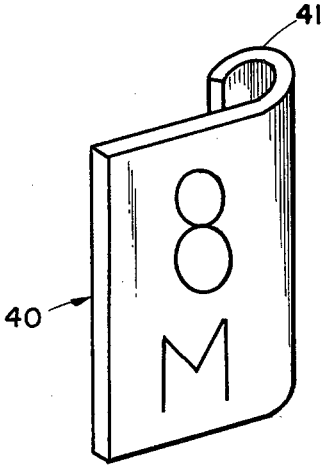
FIG. 8 is an oblique view of a modified form of tally usable with this invention.

The information to be provided by the tally 20 is imprinted or otherwise impressed on the tally. One form of the tally is a small, rectangular printed sheet 25 which preferably is supplied with a self-adhering backface so that it may be applied to the front face of the panel (FIG. 8). This type of tally is of the removable type and, if the hanger is to be used for a different garment, the tally sheet can be stripped off and replaced with a new tally sheet having different indicia.

Figure 5:
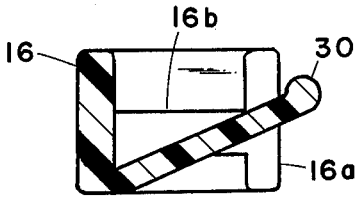
FIG. 5 is a sectional view similar to FIG. 4 illustrating a modified construction for the tally mounting panel.
Figure 6:
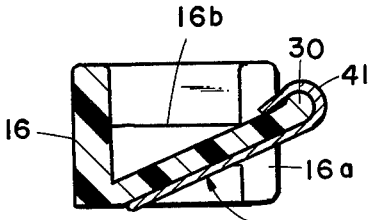
FIG. 6 is a sectional view similar to FIG. 5 illustrating a tally installed on the supporting panel.
Figure 9:
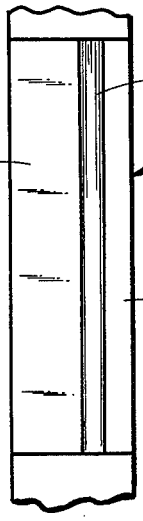
FIG. 9 is a fragmentary view of the rear face of the panel.
Figure 7:
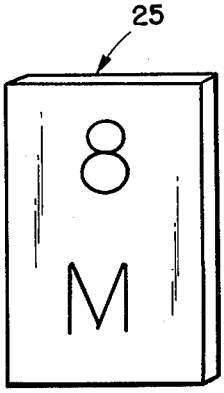
FIG. 7 is an oblique view of one form of tally usable with this invention.

An alternate construction is illustrated in FIGS. 5, 6 and 7 in which the free edge of the panel is provided with a rearwardly extending lip 30. The lip 30 preferably is rounded and is of thickness such that it does not cause any portion of the panel to extend rearwardly beyond the plane of the rear face of the hanger. Again, this is important to permit the hangers to be stacked compactly for shipment or storage. In the case of this modified construction, the tally 40 consists of a molded or formed sheet of plastic, metal or resin-impregnated paper having a front panel on which the desired indicia appears and along one edge has a reversely bent portion forming a pocket 41. To accomplish this, it is important that the material from which the tally is made be resilient so the walls of the pocket 41 can be forced open by the lip 30 and then snap back over the lip to grip the panel. Once again it will be recognized that if the information is to be changed, the tally can be detached from the panel and replaced with the new one having the desired indicia.

It will be observed that this invention provides a simple, inexpensive means of mounting a tally on a molded, plastic garment hanger which also has the benefit of making the tally's information visible from either the front or one end of the hanger. The invention makes the use of tallys with simple, lightweight, unitary molded plastic garment hangers feasible without either increasing the cost of the garment hanger or adversely affecting its structural characteristics.

Having described a preferred embodiment of my invention, together with a modification thereof, it will be recognized that other modifications can be made. Such modifications as do not depart from the principles of the invention are to be considered as included in the hereinafter appended claims unless these claims, by their language, expressly state otherwise.

I claim:

1. Means for supporting an information bearing tally on a garment hanger, said hanger having a body portion and a supporting hook molded as a single unitary member; said body portion having front and back faces; said hook having a base portion, a convexly curved anchor portion and an intermediate portion, said intermediate portion being straight and substantially vertical and spaced substantially above said body portion by said base portion of said hook and having a panel element integral with the hook and inclined at a minor angle to the lengthwise axis of said body portion, the front face of said panel element being flat for receiving an indicia bearing tally visible from the front and one end of said hanger even when said hanger is supporting a garment.

2. Means for supporting an information bearing tally on a garment hanger, said hanger having a body portion and a supporting hook molded as a single unitary member; said body portion having front and back faces; said hook having a base portion, a convexly curved anchor portion providing a support receiving opening and an intermediate portion, said intermediate portion being straight and substantially vertical and spaced substantially above said body portion by said base portion of said hook and having a panel element integral with the hook, said panel element having generally parallel front and back faces, the front face of said panel element adjacent said opening being flush with the plane of the front face of said body portion and being inclined rearwardly therefrom at an angle of 27° to 30° to the lengthwise axis of said body portion, the front face of said panel element being flat for receiving an indicia bearing tally visible from the front and one end of said hanger even when said hanger is supporting a garment.

3. Means for supporting an information bearing tally on a garment hanger as described in either claims 1 or 2 wherein said panel element is elongated vertically and has a width greater than the width of said intermediate portion parallel to said lengthwise axis of said body portion.

4. In combination an information bearing tally and a garment hanger as described in either claims 1 or 2 wherein said tally is an indicia bearing sheet detachably adhesively secured to the front face of said panel element.

5. In combination an information bearing tally and a garment hanger as described in either claims 1 or 2 wherein said panel element along its free edge has a rearwardly extending lip; said tally having an indicia bearing portion seated against the front face of said panel element and a portion forming a pocket along one edge adjacent the face of said tally opposite from said indicia for receiving said lip, said pocket having an access opening parallel with said edge, said opening being narrower than said lip; said tally being of a resilient material whereby said tally will clamp about said lip when it is pushed onto said panel element.

6. In combination an information bearing tally and a garment hanger as described in either claims 1 or 2 wherein said panel element along its free edge has a rearwardly extending lip; said tally being of a resilient material and having means along one edge to receive and clamp about said lip and an indicia bearing portion seated against the front face of said panel.

7. In combination an information bearing tally and a garment hanger as described in either claims 1 or 2 wherein said tally is an information bearing member detachably clamped to said panel element.

* * * * *